US005529518A

United States Patent [19]

Wood

[11] Patent Number: 5,529,518

[45] Date of Patent: Jun. 25, 1996

[54] ELECTRICAL CONTACT ASSEMBLY

[75] Inventor: Richard G. Wood, Magnolia, Tex.

[73] Assignee: Tescorp Seismic Products, Inc., Houston, Tex.

[21] Appl. No.: 354,285

[22] Filed: Dec. 12, 1994

[51] Int. Cl.[6] ..... H01R 13/187

[52] U.S. Cl. ..... 439/843; 439/842; 439/851; 439/859; 439/750

[58] Field of Search ..... 439/842–43, 851, 439/858–9, 750, 592

[56] References Cited

U.S. PATENT DOCUMENTS

| | | | |
|---|---|---|---|
| 2,932,685 | 4/1960 | Raili et al. | 174/84 |
| 4,077,692 | 3/1978 | Ellis et al. . | |
| 4,530,560 | 7/1985 | Weidler | 439/842 |
| 4,780,097 | 10/1988 | Pisatelli | 439/843 |
| 4,810,214 | 3/1989 | Yohn | 439/842 |
| 4,894,031 | 1/1990 | Damon et al. | 439/885 |
| 5,162,003 | 11/1992 | Johnson et al. | 439/842 |
| 5,340,337 | 8/1994 | Pentz | 439/843 |
| 5,387,119 | 2/1995 | Wood | 439/589 |

FOREIGN PATENT DOCUMENTS

| | | | |
|---|---|---|---|
| 4233951 | 4/1994 | Germany . | |
| 3155073 | 7/1991 | Japan | 439/842 |
| 2064234 | 6/1981 | United Kingdom . | |

*Primary Examiner*—P. Austin Bradley
*Assistant Examiner*—Jill Demello
*Attorney, Agent, or Firm*—P. Weston Musselman, Jr.; Robert A. McFall

[57] ABSTRACT

An electrical contact assembly has an elongated body portion and a sleeve member that has a head provided thereon. The body portion includes a socket, disposed at one end of the body portion, for receiving a pin contact. The head of the sleeve member has an enlarged opening for guiding the pin contact into the socket. The sleeve member also provides an important covering over side wall openings in the socket to prevent intrusion of nonconductive molten material during pressure molding of an electrical connector that may have one or more of the electrical contact assemblies encapsulated therein.

11 Claims, 1 Drawing Sheet

ELECTRICAL CONTACT ASSEMBLY

TECHNICAL FIELD

This invention relates generally to a socket-type electrical contact assembly, and more particularly to such an assembly that is encapsulatable within a nonconductive plastic material to form one element of an electrical connector.

BACKGROUND ART

Electrical connectors having a plurality of socket-type contacts encapsulated within a molded body are well known. For example, co-pending U.S. patent application Ser. Nos. 08/134,075 U.S. Pat. No. 5,387,119 titled Waterproof Electrical Connector, and 08/226,009 U.S. Pat. No. 5,470,248 titled Field Repairable Electrical Connector, filed respectively on Oct. 8, 1993 and Apr. 11, 1994 by the inventor of the subject matter claimed herein, disclose electrical connectors formed by injection molding a nonconductive plastic material around a plurality of contact sockets arranged in a preselected pattern.

Heretofore, there have been two major problems associated with the prepositioning of the contacts and molding of the connector. The first difficulty is attributable to the very small tolerances, typically about 0.001 inch (0.025 mm), that must be maintained to assure mating alignment of the sockets with the pins that are subsequently inserted into the socket contacts to form an electrical connection. The contact pins may have a very small diameter, for example about 0.040 inch (0.1 mm) or less, and can be easily bent during insertion into the receiving socket if not properly aligned. Electrical connectors of this type may contain 30 or more individual contacts, and even with the aid of keys and keyways provided in mating portions of connectors, providing perfect alignment of all the pins and their respective mating sockets has been a continuing and consistently difficult challenge to the manufacturers of such connectors.

Secondly, it has been difficult to prevent the intrusion of nonconductive material into the interior of the socket of the contact during molding of the connector. Typically, the connectors are formed by high pressure injection molding of a molten plastic around the sockets which are prepositioned in a mold cavity. Often, the socket contacts have one or more lateral openings in the side wall of the socket as a result of forming spring contacts in the socket wall to assure good electrical connection with a mating pin. To prevent intrusion of molten plastic through the sidewall opening, covering sleeves have been installed over outer surface of the socket prior to molding. This arrangement has been successful in preventing sidewall intrusion of nonconductive material into the socket, but has not solved the problem of intrusion of molten material into the open end of the socket. The use of temporary plugs and mold pins to seal over the open end of the socket contact has been only partially successful due, in large measure, to the critical accuracy to which such blocking members must be positioned and maintained in order to be perfectly aligned with the small opening.

The present invention is directed to overcoming the problems set forth above. It is desirable to have an electrical contact assembly that provides an enlarged "target" area for a mating pin, and then guide the pin into the socket during insertion. It is also desirable to have such an electrical contact assembly that prevents intrusion of nonconductive material into the socket opening during molding of a connector assembly.

DISCLOSURE OF THE INVENTION

In accordance with one aspect of the present invention, an electrical contact assembly has an elongated body portion, and a sleeve member having an inner surface, that is in biased contact with an outer surface of the body portion. The body portion has an inner cylindrical wall surface that defines a pin-receiving socket at a first end of the body portion. The sleeve member includes a head, disposed adjacent the first end of the body portion, that has a face surface, a bore, and a convergent frusto-conical surface extending from the face surface to the bore.

Other features of the electrical contact assembly include the sleeve member having an outer surface radially spaced from the inner surface that is in biased contact with the body portion, and the head of the sleeve member having an outer circumferential surface that has a diameter greater than the outer surface of sleeve member radially spaced from the inner surface that is in biased contact with the body portion.

In another aspect of the present invention, an electrical connector has a plurality of electrical contact socket assemblies disposed in a prearranged pattern. Each of the contact assemblies have a body portion and a sleeve member with at least a portion of each encased within an electrically nonconductive material.

Other features of the electrical connector include the head of the sleeve member having a rear shoulder, spaced from the face surface, that is in abutting contact with the nonconductive material encasing portions of the body portion and sleeve member.

BEST MODE FOR CARRYING OUT THE INVENTION

Figure 3:
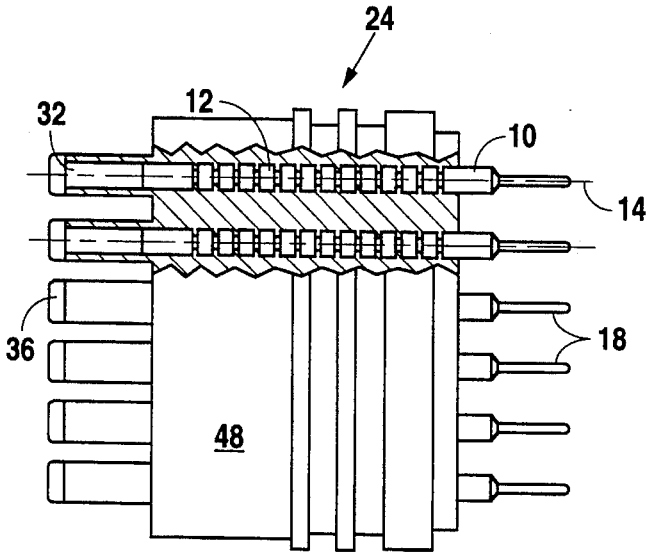
FIG. 3 is an elevational view of an electrical connector embodying the present invention, with a section of the body of the connector broken away to show the electrical contacts encased therein.

In the preferred embodiment of the present invention, an electrical contact assembly 10 includes an elongated body portion 12 that is formed of an electrically conductive material such as copper, and is generally symmetrically formed around a centrally disposed longitudinal axis 14 that extends between a first end 16 and a spaced apart second end 18. In the arrangement of the contact assembly 10 shown in the drawings, the second end 18 has a conventional pin contact formed thereon. Alternatively, the second end 18 may have a different configuration, such as a solder lug. The intermediate area of the outer surface of the body portion advantageously has a plurality of lands 20 and grooves 22 which aid in retaining the contact assembly when encased within an electrically nonconductive, normally rigid, material as part of an electrical connector 24, as shown in FIG. 3.

The first end 16 of the body portion 12 has an outer surface 26 and an inner cylindrical wall surface 28, both of which are formed to a respective predetermined diameter. The inner cylindrical wall surface 28 defines a pin-receiving socket that extends inwardly from the first end 16 in coaxial alignment with the longitudinal axis 14. Typically, the pin-receiving socket 28 has one or more radially inwardly projecting surfaces, such as deformable convex buttons or deflectable spring fingers, to assure good contact with a mating pin. In the preferred embodiment of the present invention, the electrical contact has a four leaf contact arrangement that is formed by cutting slots 30 through the socket wall at the first end 16 of the body portion 12. The slotting operation forms pairs of closely spaced apart radial walls between the inner cylindrical wall surface 28 and the outer surface 26, and separate the cylindrical wall into biased segments that can flex independently of each other.

The electrical contact assembly 10 embodying the present invention also includes a preformed sleeve member 32 that has an inner surface 34 encircling, in covering relationship, the outer surface 16 at the first end 16 of the body portion 12. Importantly, the sleeve member 32 has a light press or interference fit, or is crimped over the outer surface 26, to maintain the sleeve in biased contact with the outer surface 16 during assembly and molding operations. Also, the sleeve member 32 provides a beneficial coverage over the slotted openings 30 at the first end 16 of the body portion. In the preferred embodiment of the present invention, the sleeve member 32 is formed of beryllium copper and plated with nickel for resistance to corrosion in adverse operating environments. Alternatively, the sleeve member 32 could be constructed from another metallic composition, or it may be molded or machined from a synthetic material that has a higher melting temperature than the nonconducting material in which it is, at least partially; encased.

Figure 1:
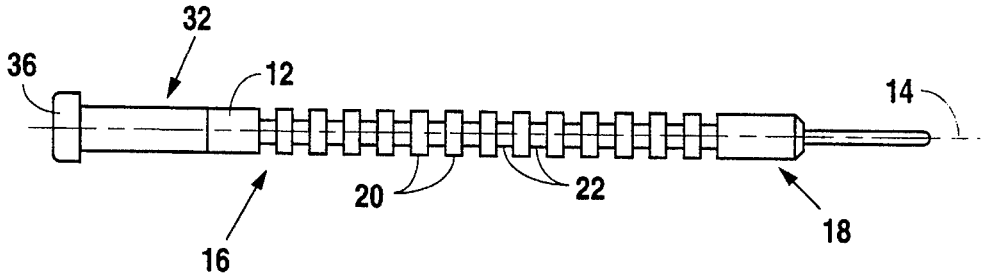
FIG. 1 is an elevational view of an electrical contact assembly embodying the present invention.
Figure 2:
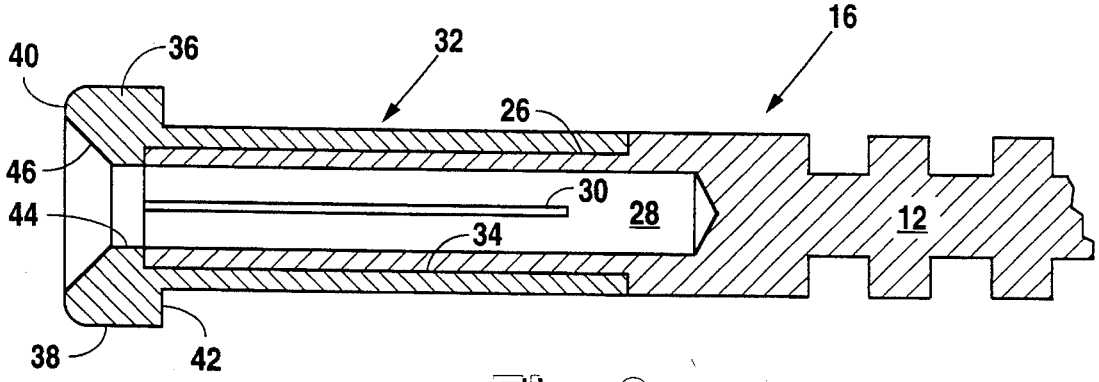
FIG. 2 is a sectional view of one end of the electrical contact assembly embodying the present invention.

Importantly, as best shown in FIG. 2, the sleeve member 32 has a solid annular enlarged head 36 that, after assembly with the body portion 12, abuts the outer end of the first end 16. The head 36, has an outer circumferential surface 38 that has is larger, i.e., it has a greater diameter, than the outer surface of the sleeve member that is radially spaced from the inner surface 34 in biased contact with the body portion 12. The head 36 also has a face surface 40 normal to the longitudinal axis 14, a rear shoulder 42 spaced from the face surface 40, and a bore 44 coaxially aligned with the longitudinal axis 14. Desirably, the bore 44 has a diameter equal to the diameter of the socket 28 in the body portion 12.

The head 36 also has an important frusto-conically shaped surface 46 that converges, preferably at about a 45 degree angle, from the front face 40 to the bore 42 of the head. In the preferred embodiment of the present invention, the diameter of the frusto-conical surface 46 at the face 40 is about twice the diameter of the surface 44 at the bore 44. The frusto-conical surface 46 advantageously provides an enlarged "target" for receiving and guiding incoming contact pins during the interconnection of pin and socket connectors, and demonstratively reduces the occurrence of bent contact pins.

The electrical connector 24, shown in FIG. 3, embodies another aspect of the present invention. The connector 24, as shown, is adapted to be mounted in a wall of a panel or measuring instrument, and has at least one, and preferably a plurality, of the electrical contact assemblies 10 arranged in a predetermined pattern within the connector 24. Preferably, the connector 24 is formed by injection molding a nonconductive material, such as glass filled urethane, that upon solidification provides a single, hard and rigid body 48 with the prearranged electrical contact assemblies 10 encapsulated therein. Alternatively, the body 48 of the connector 24 could be formed of a relatively soft nonconductive material, such as neoprene rubber. It is desirable that the nonconductive material exhibit a small amount of shrinkage upon solidification during the molding process to assure firm engagement of the nonconductive material about the elongated body portion 12 of the contact 10.

In the preferred embodiment of the connector 24, the nonconductive body 48 extends outwardly from a recessed faced to cover the outer surface of the sleeve member 32, and abuts the rear shoulder 42 of the head 36. Alternatively, the entire nonconductive molded body 48 of the connector 24 could extend outwardly so that the first end 16 of the body portion 16, the rear shoulder 42, and the outer circumferential surface 38 of the head 36, would be completely encased within the nonconductive body 48 of the connector 24. In this alternative arrangement, the nonconductive body 48 would have a face surface substantially flush with, but not covering, the face surface 40 of the head 38.

Industrial Applicability

The electrical contact assembly 10, and the electrical connector 24 having a plurality of the contact assemblies 10 arranged therein, is particularly useful in multiple conductor applications, such as for data transmission and retrieval. In particular, the enlarged "target" opening for the pin member of the connection prevents undesirable, and often only later detected, damage to the pin. Thus, the present invention has important significance when used in adverse operating environments, such as underwater or in remote geographic locations where repair of damaged contact pins would be difficult, and often, costly.

The electrical contact assembly 10 is also useful in the manufacturing of pressure molded electrical connectors 24, by providing a covering sleeve over any openings in the contact assembly 10 that lie adjacent the molded material. Also, the head 36 of the sleeve member 32 provides protection from nonconductive material infiltration into the socket 28 of the contact assembly 10 during pressure molding of the connector 24.

Thus, the electrical contact assembly 10 embodying the present invention provides improved connectability and reduces the heretofore required extremely tight tolerances and alignment that must be maintained during the pressure molding of multiple socket electrical connectors. These improvements not only reduce the cost of making and maintaining the mold equipment, but also increase production rates with less scrap.

Other aspects, features and advantages of the present invention can be obtained from a study of this disclosure, the drawings and the appended claims.

What is claimed is:

1. An electrical contact assembly, comprising:

an elongated body portion formed of an electrically conductive material and having a longitudinal axis extending between first and second spaced ends of the body portion, a predetermined outer surface, and an inner cylindrical wall surface having a predetermined diameter and defining a pin-receiving socket at said first end, said cylindrical wall surface extending inwardly from said first end in coaxially aligned relationship with said longitudinal axis; and, a preformed sleeve member having an inner surface in biased contact with a portion said outer surface of the body portion and a solid annular enlarged head disposed adjacent the first end of the body portion, said head having a face surface normal to said longitudinal axis, a bore coaxially aligned with said longitudinal axis and a diameter essentially equal to that of the inner cylindrical wall surface of the body portion, and a converging frusto-conical surface extending from said face surface to said bore.

2. An electrical contact assembly, as set forth in claim 1, wherein said body portion has a least one opening between said cylindrical wall surface and said outer surface, and said sleeve member is disposed in covering relationship over said opening.

3. An electrical contact assembly, as set forth in claim 1, wherein said sleeve member has an outer surface longitudinally aligned with and radially spaced from said inner surface of the sleeve member in biased contact with the outer surface of the body portion, and said head has an outer circumferential surface, the diameter of the outer circumferential surface of said head being greater than said outer surface longitudinally aligned with and radially spaced from the inner surface of the sleeve member.

4. An electrical contact assembly, as set forth in claim 1, wherein the diameter of said frusto-conical surface at the face surface of the head is at least twice the diameter of said frusto-conical surface at the bore in said head.

5. An electrical contact assembly, as set forth in claim 1, wherein said body portion has a plurality of radial walls extending from said cylindrical wall surface to the outer surface of said body portion, said radial walls defining a plurality of slots extending longitudinally from said first end of the body portion to a position spaced from said first end.

6. An electrical contact assembly, as set forth in claim 5, wherein said sleeve member completely encircles said slots in the body portion.

7. An electrical connector having at least one electrical contact socket assembly disposed at a predetermined position within said connector, said electrical contact socket assembly comprising:

a body portion formed of an electrically conductive material and having a longitudinal axis extending between first and second spaced ends of the body portion, an outer surface having at least a portion thereof encased within an electrically nonconductive material, and an inner cylindrical wall surface having a predetermined diameter and defining a pin-receiving socket at said first end, said cylindrical wail surface extending inwardly from said first end in coaxially aligned relationship with said longitudinal axis; and, a preformed sleeve member having an inner surface in biased contact with a portion said outer surface of the body portion, an outer surface having at least a portion thereof encased within an electrically nonconductive material, and a solid annular enlarged head disposed adjacent the first end of the body portion, said head having a face surface normal to said longitudinal axis, a bore coaxially aligned with said longitudinal axis having a diameter essentially equal to that of the inner cylindrical wall surface of the body portion, and a converging frusto-conical surface extending from said face surface to said bore.

8. An electrical connector, as set forth in claim 7, wherein the head of said sleeve member has a rear shoulder spaced from the face surface, said rear shoulder being in abutting contact with the nonconductive material encasing portions of the body portion and the sleeve member, and said face surface being void of any encasement by said nonconductive material.

9. An electrical connector, as set forth in claim 7, wherein the diameter of said frusto-conical surface at the face surface of the head of said sleeve member is at least twice the diameter of said frusto-conical surface at the bore in said head.

10. An electrical connector, as set forth in claim 7, wherein the body portion of said socket assembly has a plurality of radial walls extending from said cylindrical wall surface to the outer surface of said body portions defining a plurality of slots extending longitudinally from said first end of the body portion to a position spaced from said first end.

11. An electrical connector, as set forth in claim 9, wherein said sleeve member of the contact assembly completely encircles said slots in the body portion of the socket assembly.

* * * * *